US011545058B2

(12) United States Patent
Sunagare

(10) Patent No.: US 11,545,058 B2
(45) Date of Patent: Jan. 3, 2023

(54) ELECTRONIC DEVICE AND CONTROL METHOD FOR ELECTRONIC DEVICE

(71) Applicant: Sharp NEC Display Solutions, Ltd., Tokyo (JP)

(72) Inventor: Hiroshi Sunagare, Tokyo (JP)

(73) Assignee: SHARP NEC DISPLAY SOLUTIONS, LTD., Tokyo (JP)

( * ) Notice: Subject to any disclaimer, the term of this patent is extended or adjusted under 35 U.S.C. 154(b) by 0 days.

(21) Appl. No.: 17/433,502

(22) PCT Filed: Mar. 14, 2019

(86) PCT No.: PCT/JP2019/010538
§ 371 (c)(1),
(2) Date: Aug. 24, 2021

(87) PCT Pub. No.: WO2020/183699
PCT Pub. Date: Sep. 17, 2020

(65) Prior Publication Data

US 2022/0157210 A1 May 19, 2022

(51) Int. Cl.
*G09G 3/00* (2006.01)
*G09G 3/36* (2006.01)

(52) U.S. Cl.
CPC ..... *G09G 3/002* (2013.01); *G09G 3/3607* (2013.01); *G09G 2320/0233* (2013.01); *G09G 2320/0242* (2013.01); *G09G 2360/16* (2013.01)

(58) Field of Classification Search
CPC ..... G09G 3/002; G09G 3/3607; G09G 2320/0233; G09G 2320/0242; G09G 2360/16
See application file for complete search history.

(56) References Cited

U.S. PATENT DOCUMENTS

| | | | | |
|---|---|---|---|---|
| 6,128,048 | A | 10/2000 | Cho | |
| 2007/0085790 | A1 | 4/2007 | Chung et al. | |
| 2007/0132893 | A1* | 6/2007 | Miyazawa ..... | H04N 9/3182 348/E9.027 |
| 2014/0160498 | A1 | 6/2014 | Yano | |

FOREIGN PATENT DOCUMENTS

| | | | |
|---|---|---|---|
| CN | 1928704 | A | 3/2007 |
| CN | 1941869 | A | 4/2007 |
| CN | 101017314 | A | 8/2007 |

(Continued)

OTHER PUBLICATIONS

International Search Report (ISR) (PCT Form PCT/ISA/210), in PCT/JP2019/010538, dated Apr. 23, 2019.

(Continued)

*Primary Examiner* — Kenneth B Lee, Jr.
(74) *Attorney, Agent, or Firm* — McGinn I.P. Law Group, PLLC.

(57) ABSTRACT

An electronic device includes: a video signal processing unit that receives a video signal and outputs a predetermined type of signal; an arithmetic processing unit that transfers a correction segment data corresponding to a different segment between a current unevenness correction data and a previous unevenness correction data; and an unevenness correction unit that corrects the predetermined type of signal based on the current unevenness correction data.

18 Claims, 7 Drawing Sheets

(56) References Cited

FOREIGN PATENT DOCUMENTS

| | | | |
|---|---|---|---|
| CN | 103368582 | A | 10/2013 |
| CN | 104468044 | A | 3/2015 |
| CN | 104821157 | A | 8/2015 |
| CN | 105357532 | A | 2/2016 |
| CN | 105491266 | A | 4/2016 |
| CN | 107111995 | A | 8/2017 |
| JP | H03-1686 | A | 1/1991 |
| JP | 2006-153914 | A | 6/2006 |
| JP | 2007-114733 | A | 5/2007 |
| JP | 2007-166271 | A | 6/2007 |
| JP | 2014-113810 | A | 6/2014 |

OTHER PUBLICATIONS

Chinese Office Action, dated Apr. 24, 2022, in Chinese Application No. 201980093854.X and English Translation thereof.

Chinese Office Action dated Oct. 28, 2022, in corresponding Chinese Patent Application No. 201980093854.X, with an English translation thereof.

* cited by examiner

FIG. 3

| Data_OLd | 1 | 2 | 3 | 4 | 5 | 6 | 7 | 8 | 9 | 10 | 11 | 12 |
|---|---|---|---|---|---|---|---|---|---|---|---|---|
| 1st | 32 | 64 | 96 | 128 | 96 | 64 | 32 | 0 | 0 | 0 | 0 | 0 |
| | 32 | 64 | 96 | 128 | 96 | 64 | 32 | 0 | 0 | 0 | 0 | 0 |
| | 32 | 64 | 96 | 128 | 96 | 64 | 32 | 0 | 0 | 0 | 0 | 0 |
| 2nd | 24 | 48 | 64 | 96 | 64 | 48 | 24 | 0 | 0 | 0 | 0 | 0 |
| | 24 | 48 | 64 | 96 | 64 | 48 | 24 | 0 | 0 | 0 | 0 | 0 |
| | 24 | 48 | 64 | 96 | 64 | 48 | 24 | 0 | 0 | 0 | 0 | 0 |
| 3rd | 16 | 32 | 48 | 64 | 48 | 32 | 16 | 0 | 0 | 0 | 0 | 0 |
| | 16 | 32 | 48 | 64 | 48 | 32 | 16 | 0 | 0 | 0 | 0 | 0 |
| | 16 | 32 | 48 | 64 | 48 | 32 | 16 | 0 | 0 | 0 | 0 | 0 |
| 4th | 8 | 16 | 24 | 32 | 24 | 16 | 8 | 0 | 0 | 0 | 0 | 0 |
| | 8 | 16 | 24 | 32 | 24 | 16 | 8 | 0 | 0 | 0 | 0 | 0 |
| | 8 | 16 | 24 | 32 | 24 | 16 | 8 | 0 | 0 | 0 | 0 | 0 |
| 5th | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| 6th | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| 7th | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| 8th | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| 9th | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| 10th | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |

FIG. 5

50 51 52

| Data_New | 1 | 2 | 3 | 4 | 5 | 6 | 7 | 8 | 9 | 10 | 11 | 12 |
|---|---|---|---|---|---|---|---|---|---|---|---|---|
| 1st | 128 | 96 | 64 | 32 | 0 | 0 | 0 | 0 | 0 | 0 | 0 | 0 |
| | 96 | 72 | 48 | 24 | 0 | 0 | 0 | 0 | 0 | 0 | 0 | 0 |
| | 128 | 96 | 64 | 32 | 0 | 0 | 0 | 0 | 0 | 0 | 0 | 0 |
| 2nd | 96 | 64 | 48 | 24 | 0 | 0 | 0 | 0 | 0 | 0 | 0 | 0 |
| | 72 | 48 | 36 | 16 | 0 | 0 | 0 | 0 | 0 | 0 | 0 | 0 |
| | 96 | 64 | 48 | 24 | 0 | 0 | 0 | 0 | 0 | 0 | 0 | 0 |
| 3rd | 64 | 48 | 32 | 16 | 0 | 0 | 0 | 0 | 0 | 0 | 0 | 0 |
| | 48 | 36 | 24 | 12 | 0 | 0 | 0 | 0 | 0 | 0 | 0 | 0 |
| | 64 | 48 | 32 | 16 | 0 | 0 | 0 | 0 | 0 | 0 | 0 | 0 |
| 4th | 32 | 24 | 16 | 8 | 0 | 0 | 0 | 0 | 0 | 0 | 0 | 0 |
| | 24 | 16 | 12 | 6 | 0 | 0 | 0 | 0 | 0 | 0 | 0 | 0 |
| | 32 | 24 | 16 | 8 | 0 | 0 | 0 | 0 | 0 | 0 | 0 | 0 |
| 5th | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| 6th | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| 7th | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| 8th | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| 9th | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| 10th | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |
| | 0 | 0 | 0 | 0 | 0 | 0 | 0 | 0 | 0 | 0 | 0 | 0 |

ELECTRONIC DEVICE AND CONTROL METHOD FOR ELECTRONIC DEVICE

TECHNICAL FIELD

The present invention relates to an electronic device and a control method for the electronic device.

BACKGROUND ART

In electronic devices such as projectors and monitors that display images using light from liquid crystal panels, it is necessary to reduce an amount of color unevenness caused by the liquid crystal panels and an amount of luminance unevenness caused by optical systems (light sources) that irradiate the liquid crystal panels with the light.

Therefore, in conventional liquid crystal panel projector devices, a high-quality projected image is obtained by correcting RGB video signals (correcting the unevenness) using unevenness correction patterns (unevenness correction data) (see, for example, Patent Document 1).

CITATION LIST

Patent Document

[Patent Document 1] Japanese Patent Application Publication No. 2006-153914

[Patent Document 2] Japanese Patent Application Publication No. 2014-113810

SUMMARY OF THE INVENTION

Problems to be Solved by the Invention

However, it has conventionally been necessary to transfer a large amount of correction data when performing unevenness correction, thereby causing a problem that it takes time for the transfer.

Additionally, Patent Document 2 discloses an image forming apparatus that makes a determination using a difference amount between a gradation correction LUT (look-up table) obtained by executing the first calibration and a reference gradation correction LUT obtained by executing the previous first calibration (corresponding to a difference amount of correction data). However, Patent Document 2 does not disclose what amount of correction data should be transferred based on the determination result.

The present invention has been made in view of the above circumstances, and provides an electronic device and an electronic device control method capable of reducing a transfer amount of correction data when performing unevenness correction and reducing the time for the correction data.

Means for Solving the Problems

In order to solve the above problems, one aspect of the present invention is an electronic device comprising: a video signal processing unit that receives a video signal and outputs a predetermined type of signal; an arithmetic processing unit that transfers a correction segment data corresponding to a different segment between a current unevenness correction data and a previous unevenness correction data; and an unevenness correction unit that corrects the predetermined type of signal based on the current unevenness correction data.

Further, one aspect of the present invention is a control method for an electronic devices, comprising: a signal output step for a video signal processing unit to receive a video signal and output a predetermined type of signal; a transfer step for an arithmetic processing unit to transfer a correction segment data corresponding to a different segment between a current unevenness correction data and a previous unevenness correction data; and a correction step for an unevenness correction unit to correct the predetermined type of signal based on the current unevenness correction data.

Effects of the Invention

According to one aspect of the present invention, it is possible to provide an electronic device and an electronic device control method capable of reducing the transfer time of the correction data when performing the unevenness correction.

BRIEF DESCRIPTION OF THE DRAWINGS

FIG. 3 is a diagram for explaining correction data computed by the arithmetic processing unit 6 shown in FIG. 1.

FIG. 5 is a diagram for explaining correction data computed by the arithmetic processing unit 6 shown in FIG. 1.

MODE FOR CARRYING OUT THE INVENTION

Figure 1:
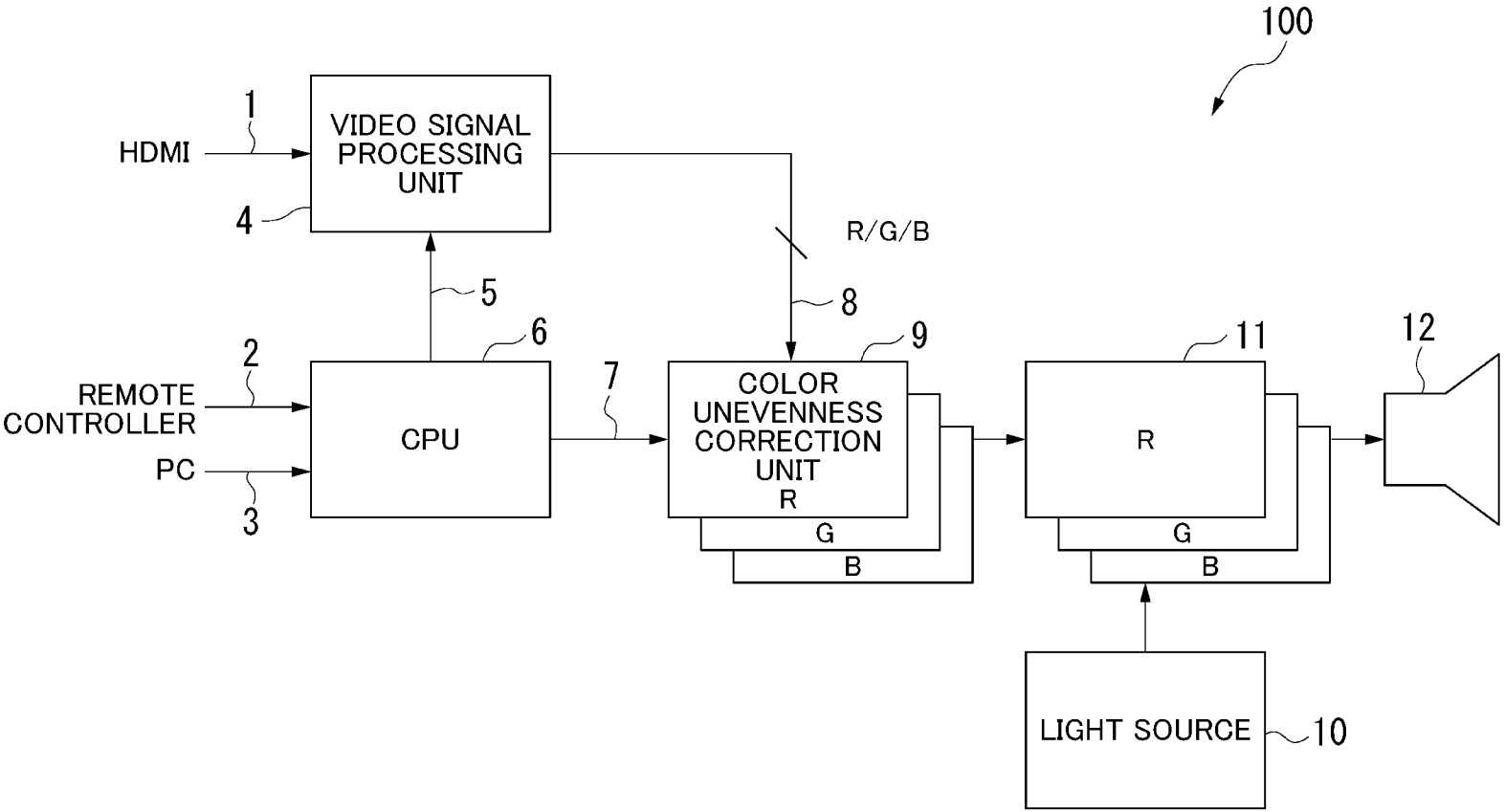
FIG. 1 is a block diagram showing a configuration example of an electronic device according to an embodiment of the present invention.

FIG. 1 is a block diagram showing a configuration example of an electronic device according to an embodiment of the present invention.

As shown in FIG. 1, a projector 100 (electronic device) includes a video signal processing unit 4, a CPU 6 (hereinafter referred to as an arithmetic processing unit 6), a color unevenness correction unit (unevenness correction unit) 9, a light source 10, a liquid crystal panel 11, and a projection lens 12.

A signal line 1 represents a communication path based on the HDMI (registered trademark; High Definition Multimedia Interface) communication standard. An HDMI signal, which is a video signal, is inputted to the video signal processing unit 4.

A signal line 2 represents a communication path based on a remote control input. A remote control input is inputted to the arithmetic processing unit 6.

A signal line 3 represents a communication path based on a LAN input. A LAN input is inputted to the arithmetic processing unit 6. Here, the signal line 3 is connected to a personal computer not shown in FIG. 1, and the personal computer is installed with, for example, a color unevenness correction setting application shown in FIG. 2 (details will be described later).

The video signal processing unit 4 receives a video signal and outputs a predetermined type of signal.

For example, the video signal processing unit 4 receives an HDMI signal and outputs to a signal line 8, an RGB signal which is three types of color signals of R (red)/G (green)/B (blue). Here, the video signal processing unit 4 converts the RGB signal and outputs the converted signal, or outputs the RGB signal to the signal line 8 as it is without converting the RGB signal.

Here, the predetermined type of signal may be a YUV (Y: luminance signal, U: difference between luminance component and blue component (also referred to as Cb or Pb), V: difference between luminance component and red component (also referred to as Cr or Pr)) signal, which is different in format from the RGB signal and suppresses an amount of information in a color direction and widens an amount of information in a luminance direction.

Additionally, the predetermined type of signal may be a signal having the same resolution as the resolution of the liquid crystal panel 11. This is because the accuracy of the unevenness correction by the color unevenness correction unit 9 can be enhanced by performing the correction for a signal having the same resolution as the resolution of the liquid crystal panel 11.

The signal line 8 is a signal line that connects the video signal processing unit 4 and the color unevenness correction unit 9. Among the RGB signals outputted from the video signal processing unit 4, the R signal and the color unevenness correction unit R are connected. Further, among the RGB signals outputted from the video signal processing unit 4, the G signal and the color unevenness correction unit G are connected. Further, among the RGB signals outputted from the video signal processing unit 4, the B signal and the color unevenness correction unit B are connected.

Further, the video signal processing unit 4 has an on-screen display (hereinafter referred to as OSD) function that displays a menu or the like based on a remote controller/LAN input inputted from a signal line 5.

The signal line 5 represents a signal line for the arithmetic processing unit 6 to cause the video signal processing unit 4 to display the OSD.

The arithmetic processing unit 6 processes a basic operation of the projector 100.

The arithmetic processing unit 6 computes color unevenness data (correction data) based on a LAN input from a personal computer installed with the color unevenness correction setting application, and transfers to the color unevenness correction unit 9, a segment of the correction data (correction segment data) which is a result of the computation.

Hereinafter, in the present embodiment, the description will be continued using "previous unevenness correction data" and "current unevenness correction data" as the correction data.

Here, the "correction segment data" is the correction data corresponding to a segment of the "current unevenness correction data," which is different from the "previous unevenness correction data."

Further, the "previous unevenness correction data" means data in the video signal inputted to the video signal processing unit 4, the data having been used by the color unevenness correction unit 9 for the correction until the arithmetic processing unit 6 has computed the "current unevenness correction data."

Additionally, the "current unevenness correction data" means data in the video signal inputted to the video signal processing unit 4, the data being used by the color unevenness correction unit 9 uses for the correction. The "current unevenness correction data" is correction data obtained by replacing with the "correction segment data," correction data corresponding to a segment of the "previous unevenness correction data," which is different from the "current unevenness correction data."

That is, the "previous unevenness correction data" is the data used by the color unevenness correction unit 9 for the correction. The color unevenness correction unit 9 uses the "previous unevenness correction data" for the correction until the arithmetic processing unit 6 computes the "current unevenness correction data."

Then, after the arithmetic processing unit 6 computes the "current unevenness correction data," the arithmetic processing unit 6 transfers to the color unevenness correction unit 9, the "correction segment data" corresponding to the segment of the "current unevenness correction data," which is different from the "previous unevenness correction data."

After receiving the "correction segment data," the color unevenness correction unit 9 replaces with the "correction segment data," the correction data corresponding to the segment of the "previous unevenness correction data," which is different from the "current unevenness correction data," thus generating the "current unevenness correction data." Then, the color unevenness correction unit 9 performs correction using the generated "current unevenness correction data." As a matter of course, the "current unevenness correction data" generated by the color unevenness correction unit 9 and the "current unevenness correction data" computed by the arithmetic processing unit 6 come to be the same data.

A signal line 7 represents a three-line serial signal (including three lines: an enable signal, a clock signal, and a data signal) for transferring to the color unevenness correction unit 9, the correction segment data which is computed by the arithmetic processing unit 6 and is a segment of the color unevenness data (correction data) held by the arithmetic processing unit 6.

The color unevenness correction unit 9 corrects a gradation value of each pixel by, for example, adding the correction data to the gradation value for each pixel of the inputted RGB signal, thus correcting the color unevenness of the RGB signal.

Here, in the present embodiment, the color unevenness correction unit 9 performs color unevenness correction on the RGB signal from the video signal processing unit, based on the "current unevenness correction data" generated by itself.

That is, the correction data corresponding to the segment of the "current unevenness correction data," which is computed by the arithmetic processing unit 6 and which is different from the "correction segment data," is included in the "previous unevenness correction data" that has already been transferred. Therefore, in the current color unevenness correction, the color unevenness correction unit 9 uses the "previous unevenness correction data" for the correction data corresponding to the segment of the "current unevenness correction data," which is computed by the arithmetic processing unit 6 and which is different from the "correction segment data."

On the other hand, in the current color unevenness correction, the color unevenness correction unit 9 uses the currently transferred "correction segment data" for the correction data corresponding to the "correction segment data" of the "current unevenness correction data" computed by the arithmetic processing unit 6.

In this way, the color unevenness correction unit 9 replaces with the "correction segment data," the correction data of the "previous unevenness correction data," which is different from the "current unevenness correction data" computed by the arithmetic processing unit 6. Then, the color unevenness correction unit 9 performs color unevenness correction using the replaced correction data ("current unevenness correction data") (details will be described later).

Here, the color unevenness correction unit 9 is built in a scaler or a liquid crystal driver that performs image processing/image conversion.

The light source 10 is a lamp, a laser, or the like. The light source 10 irradiates the liquid crystal panel with light.

The liquid crystal panel 11 transmits and blocks the light emitted by the light source 10 in response to three types of color RGB images (RGB signals) via three R/G/B color filters.

The projection lens 12 forms on a screen (not shown in FIG. 1), an image of the three types of color images (RGB signals) that have passed through the liquid crystal panel 11.

Figure 2:
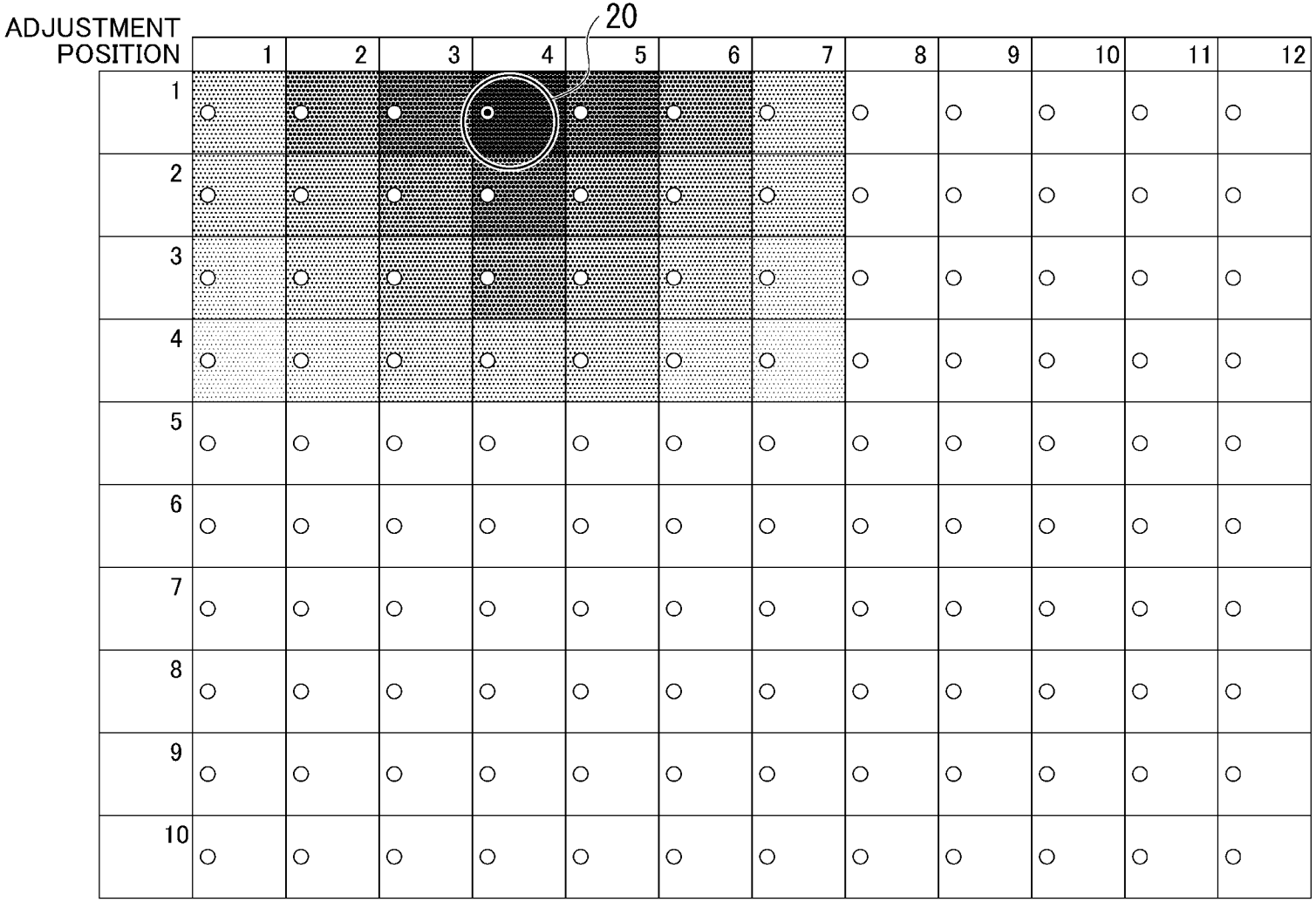
FIG. 2 is a diagram for explaining correction data computed by an arithmetic processing unit 6 shown in FIG. 1.
Figure 4:
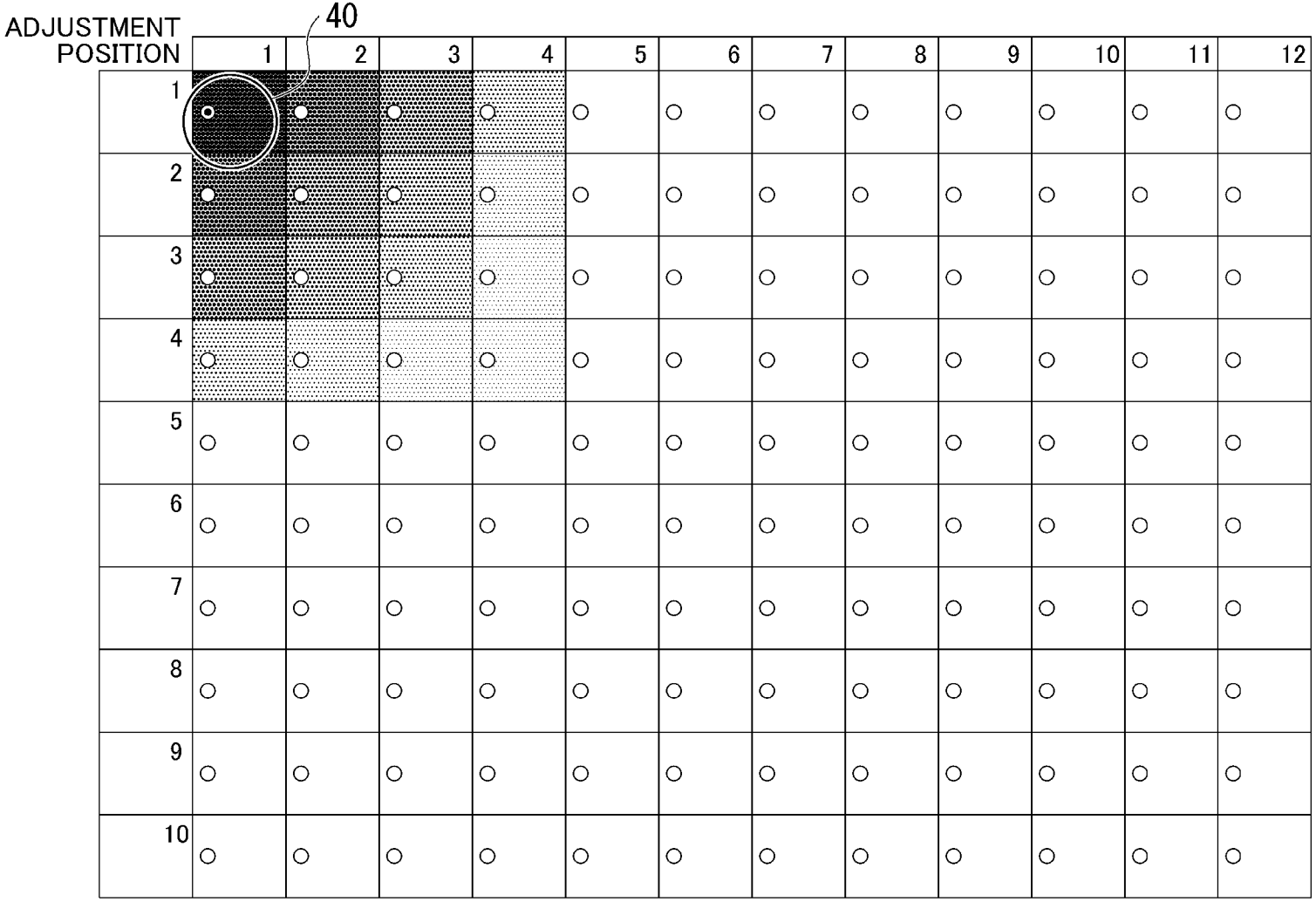
FIG. 4 is a diagram for explaining correction data computed by the arithmetic processing unit 6 shown in FIG. 1.

Here, the correction data computed by the arithmetic processing unit 6 will be described with reference to FIGS. 2 to 5. FIGS. 2 to 5 are diagrams for explaining the correction data computed by the arithmetic processing unit 6 shown in FIG. 1. Among these, FIGS. 2 and 4 are projected images in the projector 100, and show examples in which color unevenness and luminance unevenness are occurring. Further, FIGS. 3 and 5 show unevenness correction data (correction data) used when correcting the projected images shown in FIGS. 2 and 4, respectively.

Further, FIG. 2 is a previous projected image, and FIG. 3 shows color unevenness correction values (array data Data_Old) when the setting of FIG. 2 is used. Further, FIG. 4 is a current projected image, and FIG. 5 shows color unevenness correction values (array data Data_New) when the setting of FIG. 4 is used.

Here, in FIGS. 2 to 5, as arrangement directions, a vertical direction represents rows 1 to 10, and a horizontal direction represents columns 1 to 12. Hereinafter, in the present embodiment, the array data Data_Old is referred to as "previous correction data Data_Old [10×12]," and the array data Data_New is referred to as the "current correction data Data_New [10×12]."

Further, in the previous correction data Data_Old [10×12] and the current correction data Data_New [10×12], the color unevenness correction data of R is shown in the upper row of each row (1st, 2nd, 3rd, 4th, . . . , 10th), the color unevenness correction data of G is shown in the middle row, and the color unevenness correction data of B is shown in the lower row.

That is, FIG. 2 is a diagram of the previous color unevenness correction in which the horizontal width is 3, the vertical width is 3, the R/G/B gain is 128, and the center point is the 1st row and the 4th column Hereinafter, the center point will be referred to as coordinates 1-4. Further, FIG. 3 shows R/G/B color unevenness correction values (array Data_Old [10×12]) when the setting shown in FIG. 2 is used. Further, FIG. 4 is a diagram of the current color unevenness correction in which the horizontal width is 3, the vertical width is 3, the R/B gain is 128, the G gain is 96, and the center point is coordinates 1-1. Further, FIG. 5 shows R/G/B color unevenness correction values (Data_New [10×12]) when the setting shown in FIG. 4 is used.

Further, 20 shown in FIG. 2 indicates the previous remote control input and menu display by OSD (remote control input from the user), or the previous correction center point specified by the PC application software.

Further, 40 shown in FIG. 4 indicates the current remote control input and menu display, or the current correction center point specified by the PC application software.

Further, 50 to 52 shown in FIG. 5 show the following states.

50 shown in FIG. 5 shows a case where a sequence of data respectively differ from the previous data. That is, in the current correction data Data_New [10×12] shown in FIG. 5, for example, the color unevenness correction data of R in (row=1, columns=1 to 4) are 128, 96, 64, 32. On the other hand, in the previous correction data Data_Old [10×12] shown in FIG. 3, the color unevenness correction data of R in (row=1, columns=1 to 4) are 32, 64, 96, 128. That is, 50 shown in FIG. 5 shows the case where a sequence of data respectively differ from the previous data.

Here, in FIG. 5, in addition to the color unevenness correction data of R in (row=1, columns=1 to 4), there are nine cases where a sequence of data respectively differ from the previous data, which are the color unevenness correction data of G in (row=1, columns=1 to 4), the color unevenness correction data of B in (row=1, columns=1 to 4), the color unevenness correction data of R in (row=2, columns=1 to 4), the color unevenness correction data of B in (row=2, columns=1 to 4), the color unevenness correction data of R/G/B in (row=3, columns=1 to 4), the color unevenness correction data of R in (row=4, columns=1 to 4), and the color unevenness correction data of B in (row=4, columns=1 to 4).

51 shown in FIG. 5 shows a case where a sequence of same three data respectively differ from the previous data. That is, in the current correction data Data_New [10×12] shown in FIG. 5, for example, the color unevenness correction data of R in (row=1, columns=5 to 7) are 0, 0, 0. On the other hand, in the previous correction data Data_Old [10×12] shown in FIG. 3, the color unevenness correction data of R in (row=1, columns=5 to 7) are 96, 64, 32. That is, 51 shown in FIG. 5 shows the case where a sequence of same three data respectively differ from the previous data.

Here, in FIG. 5, in addition to the color unevenness correction data of R in (row=1, columns=5 to 7), there are eleven cases where a sequence of same three data respectively differ from the previous data, which are the color unevenness correction data of G/B in (row=1, columns=5 to 7), the color unevenness correction data of R/G/B in (row=2, columns=5 to 7), the color unevenness correction data of R/G/B in (row=3, columns=5 to 7), and the color unevenness correction data of R/G/B in (row=4, columns=5 to 7).

52 shown in FIG. 5 shows a case where a sequence of data includes both a segment same as the previous data and a segment different from the previous data. That is, in the current correction data Data_New [10×12] shown in FIG. 5, for example, the color unevenness correction data of G in (row=2, columns=1 to 4) are 72, 48, 36, 16. On the other hand, in the previous correction data Data_Old [10×12] shown in FIG. 3, the color unevenness correction data of G in (row=2, columns=1 to 4) are 24, 48, 64, 96. That is, 52 shown in FIG. 5 shows the case where both the segment different from the previous data (columns=1, 3 to 4) and the segment same as the previous data (column=2) are included.

Here, in FIG. 5, in addition to the color unevenness correction data of G in (row=2, columns=1 to 4), there is one case where both a segment same as the previous data and a segment different from the previous data are included, which is the color unevenness correction data of G in (row=4, columns=1 to 4).

Returning to FIG. 1, although the phenomenon called unevenness is divided into color unevenness and luminance unevenness, both color unevenness and luminance unevenness can be used in the projector 100 of the present embodiment.

Here, the color unevenness occurs due to the characteristics or variations of the liquid crystal panel 11, and differs for each R/G/B liquid crystal panel 11 as shown in FIGS. 2 to 5. Further, the luminance unevenness occurs due to variations of the light source 10, the degree of transmission of light from the light source 10 to the liquid crystal panel 11, and the like.

Further, as shown in FIGS. 3 and 5, values of the color unevenness correction data are indicated for each R/G/B, and 0 indicates no correction.

In the case of reducing the above-described color unevenness caused by the characteristics/variations of the panel and the luminance unevenness caused by the variations of the light source/degree of diffusion of light, the projector 100 of the present embodiment uses the unevenness correction.

At that time, the arithmetic processing unit 6 sets x as a variable representing a correction point (in this embodiment, x=1 to 120 (=the above-described number of rows 10×number of columns 12)), and retains (stores) the previous unevenness correction data Data_Old [x].

Here, the correction point means an address of one correction datum in the correction segment data.

That is, the arithmetic processing unit 6 transfers the correction segment data corresponding to a different segment between the current unevenness correction data Data_New [x] and the previous unevenness correction data Data_Old [x].

Then, the color unevenness correction unit 9 replaces with the correction segment data, a correction point of the previous unevenness correction data Data_Old [x], which is different from the current unevenness correction data Data_New [x] computed by the arithmetic processing unit 6. Then, the color unevenness correction unit 9 corrects the color unevenness using the current unevenness correction data Data_New [x], which is the correction data after the replacement.

As a result, in the present embodiment, the arithmetic processing unit 6 transfers the correction segment data which is a part of the current unevenness correction data Data_New [x] without sending all of the current unevenness correction data Data_New [x], and therefore is characterized by reducing the data transfer time.

Further, there are the following three transfer modes (first transfer mode to third transfer mode) depending on how the current unevenness correction data Data_New [x] differs from the previous unevenness correction data Data_Old [x].

The first mode is a mode for transferring one datum of the correction segment data.

The second mode is a mode for transferring the correction segment data corresponding to each address while incrementing from the specified start address to the Nth address.

The third mode is a mode for transferring the data same as the correction segment data corresponding to the start address while incrementing from the specified start address to the Nth address.

As a result, the arithmetic processing unit 6 is characterized by selectively using the three transfer modes (first transfer mode to third transfer mode) to reduce the data transfer time.

Here, the first transfer mode to the third transfer mode will be described in detail.

The first transfer mode is a 1-Data transfer method and requires "MODE(0)+Addr+Data" as the data transfer amount.

Further, the second transfer mode is an Addr automatic INC method and requires "MODE(1)+Addr+Data1+Data2+ . . . +DataN" as the data transfer amount.

Further, the third transfer mode is an N-piece same Data method and requires "MODE(2)+Addr+Data1+Data2 (N)" as the data transfer amount.

Here, MODE consists of 1 byte which indicates which of 0: 1-Data transfer method, 1: Addr automatic INC method, and 2: N-piece same Data method is used, Addr consists of 2 bytes, and Data consists of 5 bytes (correction amount per one correction point).

When 1 is specified in MODE (when the arithmetic processing unit 6 selects the second transfer mode), the color unevenness correction unit 9 operates in the Addr automatic INC method, and automatically increments Addr each time Data (5 Byte) is inputted. In the above example, Data1 (5 Byte) is written to Addr, and DataN is written to the address of Addr+N.

When 2 is specified in MODE (when the arithmetic processing unit 6 selects the third transfer mode), a value of Data1 is written to all the addresses of Addr to Addr+N. Further, in the case of 10 rows×12 columns, Data2(N) has a maximum value of 120. Therefore, Data2(N) is 1 byte.

Figure 6:
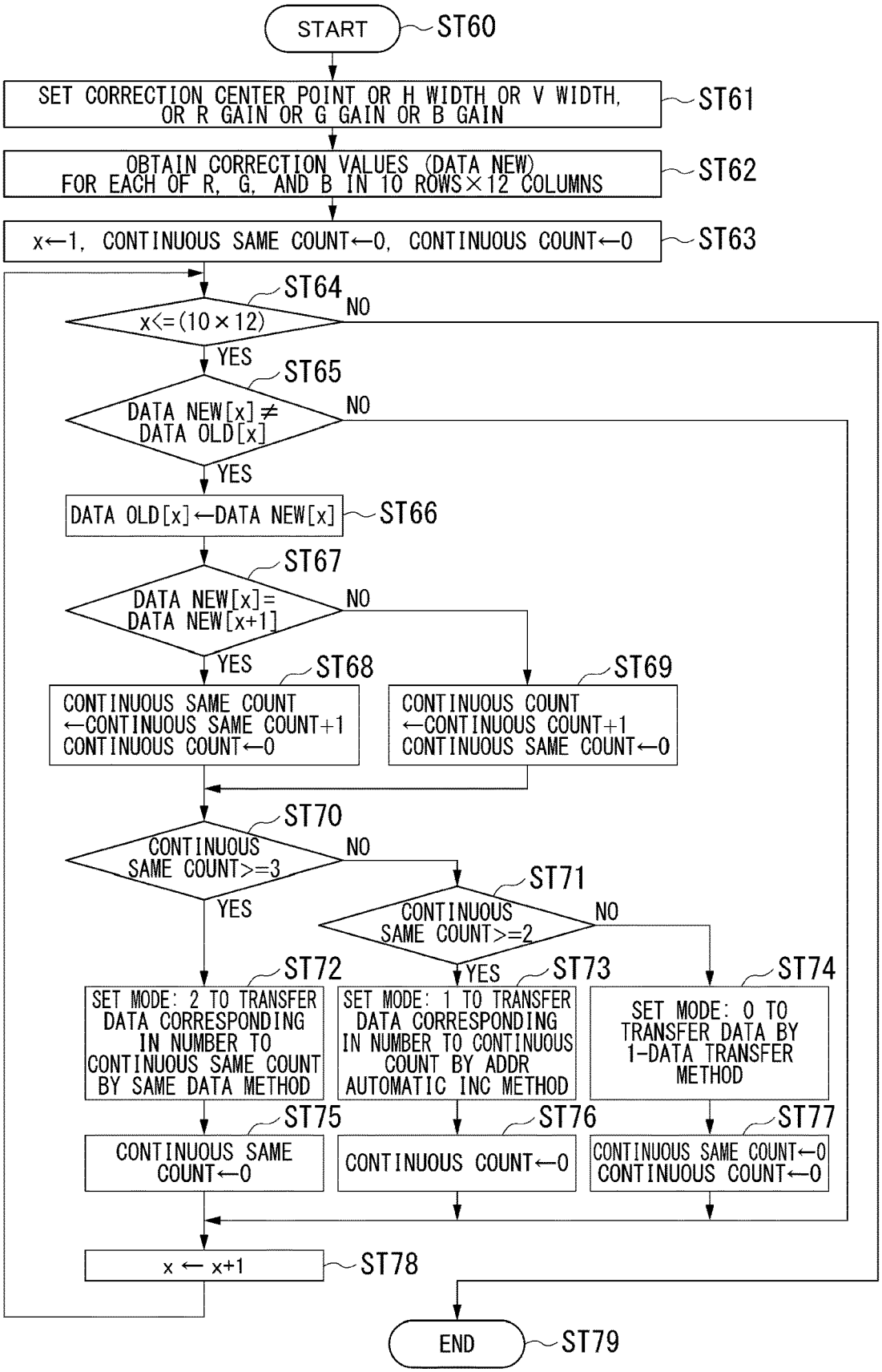
FIG. 6 is a flowchart showing a correction data transfer process performed by the arithmetic processing unit 6 shown in FIG. 1.

Next, a correction segment data transfer process of the projector 100 will be described with reference to FIGS. 1 to 6. FIG. 6 is a flowchart showing the correction segment data transfer process performed by the arithmetic processing unit 6 shown in FIG. 1.

A setting of a correction center point or H width or V width or R gain or G gain or B gain is performed (step ST61).

The arithmetic processing unit 6 uses the remote control input and OSD menu inputted from the signal line 2 or the color unevenness correction setting application software (see FIG. 4 for the screen image) installed in the personal computer to set to 40 shown in FIG. 4 via the LAN input from the signal line 3, any or all of the current correction center point coordinates 1-1, horizontal width 3, vertical width 3, R/B gain 128, and B gain 96.

Here, it is assumed that if any one is set, the previous settings will be used for the settings other than the newly set item.

Additionally, it is assumed that in the previous setting, the correction center point coordinates 1-4, horizontal width 3, vertical width 3, and R/G/B gain 128 are set to 20 shown in FIG. 2.

Correction values (Data_New) for each of R, G, and B in 10 rows×12 columns are obtained (step ST62).

The arithmetic processing unit 6 obtains correction values (correction data Data_New shown in FIG. 5) for each of R, G, and B in 10 rows×12 columns based on the current setting values.

X←1 Continuous Same Count←0, and Continuous Count←0 are set (step ST63).

The arithmetic processing unit 6 assigns an initial value 1 to the variable x, and assigns an initial value 0 to "Continuous Same Count" which is the number of same data in a sequence respectively different from the previous data, and to "Continuous Count" which is the number of different data in a sequence respectively different from the previous data.

It is determined whether or not x<=(10×12) (step ST64).

When x<=(10×12) (step ST64—Yes), it is determined whether or not Data_Old [x]≠Data_New [x] (step ST65).

When Data_Old [x]≠Data_New [x] (step ST65—Yes), Data_Old [x]←Data_New [x] is set (step ST66).

It is determined whether or not Data_New [x]=Data_New [x+1] (step ST67).

When Data_New [x]=Data_New [x+1] (step ST67—Yes), Continuous Same Count←Continuous Same Count+1, and Continuous Count←0 are set (step ST68).

On the other hand, when Data_New [x]≠Data_New [x+1] (step ST67—No), Continuous Count←Continuous Count+1, and Continuous Same Count←0 are set (step ST69).

That is, when the variable x is 10×12 (10 rows×12 columns) or less (step ST64—Yes), when Data_New [x] and Data_Old [x] are different (step ST65—Yes), the arithmetic processing unit 6 assigns the values of Data_New [x] to Data_Old [x] (step ST66), and further, when Data_New [x] and Data_New [x+1] (data at the correction point where the address is incremented by 1) have the same value (same correction value) (step ST67—Yes), performs +1 (process of incrementing by 1) on "Continuous Same Count" and sets 0 to the "Continuous Count" (step ST68).

On the other hand, when Data_New [x] and Data_New [x+1] (data at the correction point where the address is incremented by 1) have different values (different correction values) (step ST67—No), the arithmetic processing unit 6 performs+1 (process of incrementing by 1) on "Continuous Count" and sets 0 to "Continuous Same Count" (step ST69).

Here, the processes performed by the arithmetic processing unit 6 in steps ST68 and ST69 are referred to as "first count number change process."

It is determined whether or not Same Continuous Count>=3 (step ST70).

When Continuous Same Count<3 (step ST70—No), it is determined whether or not Continuous Count>=2 (step ST71).

Here, when Continuous Same Count>=3 (step ST70—Yes), Mode: 2 is set to transfer data corresponding in number to Continuous Same Count by the same Data method (step ST72).

Then, Continuous Same Count←0 is set (step ST75).

Further, when Continuous Count>=2 (step ST71—Yes), Mode: 1 is set to transfer data corresponding in number to Continuous Count by the Add automatic INC method (step ST73).

Then, Continuous Count←0 is set (step ST76).

Further, when Continuous Count<2 (step ST71—No), Mode: 0 is set to transfer data by the 1-Data transfer method (step ST74).

Then, Same Continuous Count←0 and Continuous Count←0 are set (step ST77).

That is, when the "Continuous Same Count" is 3 or more (step ST7—Yes), the arithmetic processing unit 6 sets MODE: 2 to transfer the data corresponding in number to Continuous Same Count (Continuous Same Count number) to the color unevenness correction unit 9 by the above-described N-piece same Data method (third transfer mode) (step ST72), and sets 0 to "Continuous Same Count" (step ST75).

Further, when the "Continuous Same Count" is not 3 or more (step ST70—No) and the "Continuous Count" is 2 or more (step ST71—Yes), the arithmetic processing unit 6 sets MODE: 1 to transfer data corresponding in number to Continuous Count (Continuous Count number) to the color unevenness correction unit 9 by the above-described Add automatic INC method (second transfer mode) (step ST73), and sets 0 to "Continuous Count" (step ST76).

Further, when the "Continuous Same Count" is not 3 or more (step ST70—No) and the "Continuous Count" is not 2 or more (step ST71—No), the arithmetic processing unit 6 sets MODE: 0 to perform 1-Data transfer to the color unevenness correction unit 9 by the above-described 1-Data transfer method (first transfer mode) (step ST74), and sets 0 to "Continuous Same Count" and "Continuous Count" (step ST77).

Here, the processes performed by the arithmetic processing unit 6 in step ST72, step ST73, and step ST74 are referred to as "second count number change processes."

X←X+1 is set (step ST78).

The arithmetic processing unit 6 assigns x+1 to the variable x, that is, increments by 1 (step ST78) and performs the above-described processes until the variable x exceeds 10×12 (10 rows×12 columns)=120 (final value) (step ST64—N).

Subsequently, the magnitude of the data transfer amount will be compared between the conventional method and the method of the present embodiment.

In the conventional method, in order to transfer the color unevenness data of FIG. 5, the Add automatic INC method (second transfer mode) is used as the transfer method to perform the transfer. Therefore, "MODE(1)+RED Addr+Data1+Data2+ . . . +Data120"=1+2+5×120=603 bytes, "MODE(1)+Green Addr+Data1+Data2+ . . . +Data120"=1+2+5×120 bytes=603 bytes, "MODE(1)+BLUE Addr+Data1+Data2+ . . . +Data120"=1+2+5×120=603 bytes, i.e., 1809 bytes in total are required.

On the other hand, in the method of the present embodiment, the amount of data transfer is as shown in (1) to (4) below.

(1) Since the segments of the correction data Data_New shown in FIG. 5 other than the segments of 50, 51, 52, and the segments of the correction data Data_Old shown in FIG. 3 other than the segments corresponding to the segments of 50, 51, 52 shown in FIG. 5 have the same correction value of 0, no transfer is performed.

(2) The processing segment 51 of the correction data Data_New shown in FIG. 5

For example, in the current correction data Data_New [10×12] shown in FIG. 5, the color unevenness correction data of R in (row=1, columns=5 to 7) shows the case where a sequence of same three data respectively differ from the previous data.

That is, in the current correction data Data_New [10×12] shown in FIG. 5, the color unevenness correction data of R in (row=1, columns=5 to 7) are 0, 0, 0.

On the other hand, in the previous correction data Data_Old [10×12] shown in FIG. 3, the color unevenness correction data of R in (row=1, columns=5 to 7) are 96, 64, 32.

Therefore, in the correction data Data_New [10×12] shown in FIG. 5, it is enough for the arithmetic processing unit 6 to set 5 to Red Add as the color unevenness correction segment data of R in (row=1, columns=5 to 7), and transfer Data1 (correction data=0) and Data2 (N=3) by MODE(2) for transferring 3 pieces of same data 0 corresponding in number to Continuous Count (Continuous Count), that is, N (N=3)-piece same Data method (third transfer mode).

That is, in the current correction data Data_New [10×12] shown in FIG. 5, the data transfer amount of the color unevenness correction segment data of R in (row=1, columns=5 to 7) is "MODE(2)+RED Addr+Data1: 0+Data2: 3"=1+2+5+1=9 bytes.

Further, in the current correction data Data_New [10×12] shown in FIG. 5, like the color unevenness correction data of R in (row=1, columns=5 to 7), the color unevenness correction data of R/B in (row=1, columns=5 to 7), the color unevenness correction data of R/G/B in (row=2, columns=5 to 7), the color unevenness correction data of R/G/B in (row=3, columns=5 to 7), and the color unevenness correction data of R/G/B in (row=4, columns=5 to 7) show the case where a sequence of same three data respectively differ from the previous data.

Therefore, in the current correction data Data_New [10×12] shown in FIG. 5, the data transfer amount of the correction segment data in the case where a sequence of same three data respectively differ from the previous data is 9 bytes×3 (R/G/B)×4 (rows=1 (1st) to 4 (4th))=108 bytes.

(3) The processing segment 50 of the correction data Data_New shown in FIG. 5

For example, in the current correction data Data_New [10×12] shown in FIG. 5, the color unevenness correction data of R in (row=1, columns=1 to 4) shows a case where a sequence of data respectively differ from the previous data.

That is, in the current correction data Data_New [10×12] shown in FIG. 5, the color unevenness correction data of R in (row×1, columns=1 to 4) are 128, 96, 64, 32.

On the other hand, in the previous correction data Data_Old [10×12] shown in FIG. 3, the color unevenness correction data of R in (row=1, columns=1 to 4) are 32, 64, 96, 128.

Therefore, in the current correction data Data_New [10×12] shown in FIG. 5, it is enough for the arithmetic processing unit 6 to set 1 to Red Add as the color unevenness correction segment data of R in (row=1, columns=1 to 4), and transfer Data1 (correction data=128), Data2 (correction data=96), Data3 (correction data=64), and Data4 (correction data=32) by MODE(1) for transferring 4 pieces of data corresponding in number to Continuous Same Count (Continuous Same Count), that is, by the ADD automatic INC method (second transfer mode).

Therefore, in the current correction data Data_New [10×12] shown in FIG. 5, the data transfer amount of the color unevenness correction segment data of R in (row=1, columns=1 to 4) is "MODE(1)+RED Addr+Data1 to Data4)"=1+2+5×4=23 bytes.

Further, in the current correction data Data_New [10=12] shown in FIG. 5, like the color unevenness correction data of R in (row=1, columns=1 to 4), the color unevenness correction data of G/B in (row=1, columns=1 to 4), the color unevenness correction data of R/B in (row=2, columns=1 to 4), the color unevenness correction data of R/G/B in (row=3, columns=1 to 4), and the color unevenness correction data of R/G/B in (row=4, columns=1 to 4) also shows the case where a sequence of data respectively differ from the previous data.

Therefore, in the current correction data Data_New [10×12] shown in FIG. 5, the data transfer amount of the correction portion data in the case where a sequence of data respectively differ from the previous data is 23 bytes×10 segments=230 bytes.

(4) The processing segment 52 of the correction data Data_New shown in FIG. 5

For example, in the current correction data Data_New [10×12] shown in FIG. 5, the color unevenness correction data of G in (row=2, columns=1 to 4) shows a case where a sequence of data includes both a segment same as the previous data and a segment different from the previous data.

That is, in the current correction data Data_New [10×12] shown in FIG. 5, the color unevenness correction data of G in (row=2, columns=1 to 4) are 72, 48, 36, 16.

On the other hand, in the previous correction data Data_Old [10×12] shown in FIG. 3, the color unevenness correction data of G in (row=2, columns=1 to 4) are 24, 48, 64, 96.

That is, in the current correction data Data_New [10×12], the case is shown where the color unevenness correction data of G in (row=1, columns=1 to 4) includes the segment different from the previous data (columns=1, 3 to 4) and the segment same as the previous data (column=2).

Therefore, in the current correction data Data_New [10×12] shown in FIG. 5, the arithmetic processing unit 6 sets 1 to GREEN Add as the color unevenness correction segment data of G in (row=2, column=1), and transfers Data (correction data=72) by MODE(0) for transferring 1 piece of data, that is, by the 1-Data transfer method (first transfer mode).

Further, in the correction data Data_New [10×12] shown in FIG. 5, the arithmetic processing unit 6 sets 3 to GREEN Add as the color unevenness correction segment data of G in (row=2, columns=3 to 4), and transfers Data1 (correction data=36) and Data2 (correction data=16) by MODE(1) for transferring 2 pieces of data corresponding in number to Continuous Count (Continuous Count), that is, by the ADD automatic INC method (second transfer mode).

Additionally, since the color unevenness correction data of G in (row=2, column=2) in the correction data Data_New [10×12] shown in FIG. 5 and the color unevenness correction data of G in (row=2, column=2) in the correction data Data_Old shown in FIG. 3 have the same correction value of 48, the arithmetic processing unit 6 does not perform transfer.

Therefore, in the current correction data Data_New [10×12] shown in FIG. 5, the data transfer amount of the color unevenness correction segment data of G in (row=2, columns=1 to 4) is a sum of "MODE(0)+GREEN Addr+Data"=1+2+5=8 bytes and "MODE(2)+GREEN Addr+Data1+Data2"=1+2+5×2=13 bytes, that is, a total value of 21 bytes.

Further, in the current correction data Data_New [10×12] shown in FIG. 5, like the color unevenness correction data of G in (row=2, columns=1 to 4), the color unevenness correction data of G in (row=4, columns=1 to 4) also shows the case where both a segment different from the previous data and a segment same as the previous data are included.

Therefore, in the current correction data Data_New [10×12] shown in FIG. 5, the data transfer amount of the correction part data in the case where both the segment different from the previous data and the segment same as the previous data are included is 21 bytes×2 segments=42 bytes.

From the above, the total amount of data transfer when transferring the corrected segment data different from the previous data is the total amount=(1) 0 byte+(2) 108 bytes+(3) 230 bytes+(4) 42 bytes=380 bytes.

As described above, in the projector 100 of the present embodiment, the data transfer amount (1809 bytes in the above description) required by the conventional method can be reduced to 380 bytes, so that the transfer time of the correction data when performing the unevenness correction can be reduced.

In addition, since the conventional method requires the large data transfer mount, there has been a problem that if the color unevenness data is transferred during the period when the image is visible (other than the VSYNC period), an image of dust is displayed since the color unevenness data is LUT (Lookup table). Since it takes time to transfer the color unevenness data during the VSYNC period in order not to display the image of dust, there has been a problem that the process of sequentially correcting the color unevenness is visible to the user.

When the method of the present invention is used, the amount of color unevenness data transfer is reduced. For this reason, there is also a merit that even if the transfer is performed during the VSYNC period, the process of sequentially correcting the data is not easily noticed by the user since the transfer time is short.

Further, since the transfer time is reduced, the time occupied by the processing of the arithmetic processing unit 6 is also reduced. Furthermore, the load of the arithmetic processing unit 6 is also reduced by performing the processing during the VSYNC period. That is, since the processing of the CPU is occupied/heavy load during the transfer, it is also possible to solve the problem that when the user performs an on-screen display (OSD) by remote control input or the like via the signal line 2, the user operation and the OSD cannot be displayed.

Figure 7:
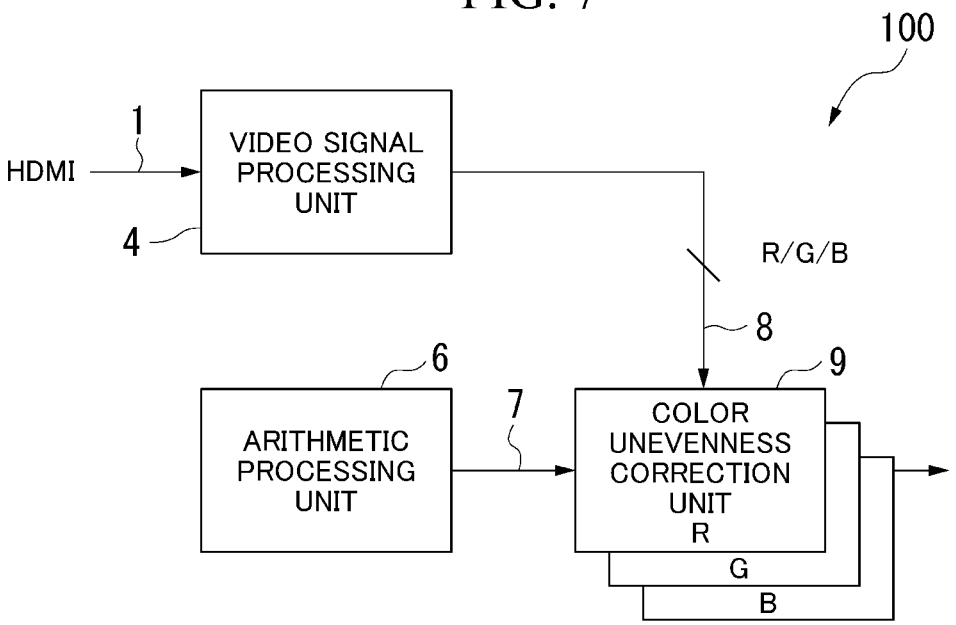
FIG. 7 is a diagram showing a minimum configuration of the electronic device according to the embodiment of the present invention.

Next, a minimum configuration of the above-described embodiment will be described with reference to FIG. 7. FIG. 7 is a diagram showing the minimum configuration of the electronic device according to the embodiment of the present invention.

The projector 100 (electronic device) includes the video signal processing unit 4, the arithmetic processing unit 6, and the color unevenness correction unit (unevenness correction unit) 9.

The video signal processing unit 4 receives an HDMI signal (video signal) and outputs an R/G/B signal (predetermined type of signal).

The arithmetic processing unit 6 transfers the correction segment data corresponding to the different segment between the current unevenness correction data and the previous unevenness correction data.

The color unevenness correction unit 9 corrects the R/G/B signal based on the current unevenness correction data.

As described above, according to the embodiment and minimum configuration example of the present invention, the amount of correction data transferred by the arithmetic processing unit 6 to the color unevenness correction unit 9 can be reduced as compared with the conventional case. It is possible to reduce the transfer time of the correction data in performing unevenness correction.

As described above, although the embodiment of the present invention has been described in detail with reference to the drawings, the specific configuration is not limited to this embodiment, and designs and the like within a range not deviating from the gist of the present invention are also included. Further, part or all of the programs executed by the computer such as one or more CPUs of the above-described embodiment can be distributed via a communication line or a computer-readable recording medium.

DESCRIPTION OF REFERENCE NUMERALS

1, 2, 3, 5, 7, 8 . . . signal line
4 . . . video signal processing unit
6 . . . arithmetic processing unit (CPU)
9 . . . color unevenness correction unit
10 . . . light source
11 . . . liquid crystal panel
12 . . . projection lens

The invention claimed is:

1. An electronic device comprising:

a video signal processing unit that receives a video signal and outputs a predetermined type of signal;

an arithmetic processing unit that transfers a correction segment data corresponding to a different segment between a current unevenness correction data and a previous unevenness correction data; and an unevenness correction unit that corrects the predetermined type of signal based on the current unevenness correction data, wherein:

the correction segment data comprises correction data corresponding to a segment of the current unevenness correction data, which is different from the previous unevenness correction data, the previous unevenness correction data comprises data in the video signal inputted to the video signal processing unit, the data having been used by the unevenness correction unit for correction until the arithmetic processing unit has computed the current unevenness correction data, and the current unevenness correction data comprises data in the video signal inputted to the video signal processing unit, the data being used by the unevenness correction unit for the correction, and the data being obtained by replacing with the correction segment data, a segment of the previous unevenness correction data, which is different from the current unevenness correction data.

2. The electronic device according to claim 1, wherein the unevenness correction unit obtains the current unevenness correction data from the previous unevenness correction data and the correction segment data transferred from the arithmetic processing unit.

3. The electronic device according to claim 1, wherein the unevenness correction unit performs the replacement with the correction segment data, on a correction point of the previous unevenness correction data, at which data is different from the current unevenness correction data, and corrects unevenness using the correction data after the replacement.

4. The electronic device according to claim 3, wherein the unevenness includes color unevenness and luminance unevenness.

5. The electronic device according to claim 1, wherein the arithmetic processing unit has a first transfer mode, a second transfer mode, and a third transfer mode for transferring the correction segment data.

6. The electronic device according to claim 5, wherein:

the first transfer mode comprises a mode for transferring one data piece of the correction segment data;

the second transfer mode comprises a mode for transferring the correction segment data corresponding to each address while incrementing from a specified start address to an Nth address; and the third transfer mode comprises a mode for transferring data same as the correction segment data corresponding to the start address while incrementing from the specified start address to the Nth address.

7. The electronic device according to claim 6, wherein the arithmetic processing unit selects the first transfer mode, the second transfer mode, and the third transfer mode, using a continuous same count which represents a number of same data in a sequence respectively different from the previous unevenness correction data, and a continuous count which represents a number of different data in a sequence respectively different from the previous unevenness correction data.

8. The electronic device according to claim 7, wherein:

the arithmetic processing unit assigns 0 to the continuous same count and the continuous count;

when data at a correction point of the current unevenness correction data differs from data at a correction point of the previous unevenness correction data, the arithmetic processing unit assigns the data at the correction point of the current unevenness correction data to the correction point of the previous unevenness correction data;

when the correction point of the current unevenness correction data and the correction point obtained by incrementing the address of the correction point by 1 have same data, the arithmetic processing unit increments the continuous same count by 1 and sets 0 to the continuous count; and when the correction point of the current unevenness correction data and the correction point obtained by incrementing the address of the correction point by 1 have different data, the arithmetic processing unit performs a first count number change process of setting 0 to the continuous same count and incrementing the continuous count by 1.

9. The electronic device according to claim 8, wherein:

as a result of the first count number change process, when the continuous same count is 3 or more, the arithmetic processing unit selects the third transfer mode, transfers data corresponding in number to the continuous same count, and then sets 0 to the continuous same count;

when the continuous same count is not 3 or more and the continuous count is 2 or more, the arithmetic processing unit selects the second transfer mode, transfers data corresponding in number to the continuous count, and then sets 0 to the continuous count; and when the continuous same count is not 3 or more and the continuous count is not 2 or more, the arithmetic processing unit selects the first transfer mode, transfers one data piece, and then performs a second count number change process of setting 0 to the continuous same count and the continuous count.

10. The electronic device according to claim 8, wherein the arithmetic processing unit increments a value of X representing an address of the correction point by 1 from X=0, and selects the first transfer mode, the second transfer mode, and the third transfer mode according to the continuous same count and the continuous count until X reaches a final value.

11. The electronic device according to claim 1, further comprising:

a light source;

a liquid crystal panel that transmits and blocks a light emitted by the light source in response to the predetermined type of signal; and a projection lens that forms on a screen, an image of the predetermined type of signal that has passed through the liquid crystal panel.

12. A control method for an electronic devices, comprising:

receiving a video signal and outputting a predetermined type of signal;

transferring a correction segment data corresponding to a different segment between a current unevenness correction data and a previous unevenness correction data; and correcting the predetermined type of signal based on the current unevenness correction data, wherein:

the correction segment data comprises correction data corresponding to a segment of the current unevenness correction data, which is different from the previous unevenness correction data;

the previous unevenness correction data comprises data in the video signal, the data having been used for correction until the current unevenness correction data has been computed; and the current unevenness correction data comprises data in the video signal, the data being used for the correction, and the data being obtained by replacing with the correction segment data, a segment of the previous unevenness correction data, which is different from the current unevenness correction data.

13. The control method according to claim 12, further comprising:

obtaining the current unevenness correction data from the previous unevenness correction data and the correction segment data.

14. The control method according to claim 12, further comprising:

performing the replacement with the correction segment data, on a correction point of the previous unevenness correction data, at which data is different from the current unevenness correction data; and correcting unevenness using the correction data after the replacement.

15. The control method according to claim 12, further comprising:

selecting a first transfer mode, a second transfer mode, and a third transfer mode for transferring the correction segment data, using a continuous same count which represents a number of same data in a sequence respectively different from the previous unevenness correction data, and a continuous count which represents a number of different data in a sequence respectively different from the previous unevenness correction data, wherein:

the first transfer mode comprises a mode for transferring one data piece of the correction segment data;

the second transfer mode comprises a mode for transferring the correction segment data corresponding to each address while incrementing from a specified start address to an Nth address; and the third transfer mode comprises a mode for transferring data same as the correction segment data corresponding to the start address while incrementing from the specified start address to the Nth address.

16. The control method according to claim 15, further comprising:

assigning 0 to the continuous same count and the continuous count;

when data at a correction point of the current unevenness correction data differs from data at a correction point of the previous unevenness correction data, assigning the data at the correction point of the current unevenness correction data to the correction point of the previous unevenness correction data;

when the correction point of the current unevenness correction data and the correction point obtained by incrementing the address of the correction point by 1 have same data, incrementing the continuous same count by 1 and setting 0 to the continuous count; and when the correction point of the current unevenness correction data and the correction point obtained by incrementing the address of the correction point by 1 have different data, performing a first count number change process of setting 0 to the continuous same count and incrementing the continuous count by 1.

17. The control method according to claim 16, further comprising:

as a result of the first count number change process, when the continuous same count is 3 or more, selecting the third transfer mode, transferring data corresponding in number to the continuous same count, and then setting 0 to the continuous same count;

when the continuous same count is not 3 or more and the continuous count is 2 or more, selecting the second transfer mode, transferring data corresponding in number to the continuous count, and then setting 0 to the continuous count; and when the continuous same count is not 3 or more and the continuous count is not 2 or more, selecting the first transfer mode, transferring one data piece, and then performing a second count number change process of setting 0 to the continuous same count and the continuous count.

18. The control method according to claim 16, further comprising:

incrementing a value of X representing an address of the correction point by 1 from X=0; and selecting the first transfer mode, the second transfer mode, and the third transfer mode according to the continuous same count and the continuous count until X reaches a final value.

* * * * *